United States Patent [19]

Abdul-Rahman

[11] 4,068,758

[45] Jan. 17, 1978

[54] FEED SYSTEM FOR A CONOIDAL SOLIDS SEPARATING SYSTEM AND METHOD OF SEPARATING

[75] Inventor: Yahia A. K. Abdul-Rahman, Plano, Tex.

[73] Assignee: Atlantic Richfield Company, Los Angeles, Calif.

[21] Appl. No.: 749,638

[22] Filed: Dec. 13, 1976

Related U.S. Application Data

[63] Continuation-in-part of Ser. No. 749,589, Dec. 10, 1976.

[51] Int. Cl.[2] ..... B07C 9/00

[52] U.S. Cl. ..... 209/112; 209/73; 209/498

[58] Field of Search ..... 209/112, 73, 124, 479, 209/480, 471, 472, 459, 116, 117, 497, 498; 198/392, 540, 562, 636, 637

[56] References Cited

U.S. PATENT DOCUMENTS

| | | | |
|---|---|---|---|
| 776,189 | 11/1904 | LeStrange | 209/498 X |
| 1,291,278 | 1/1919 | Ulrich | 209/112 |

FOREIGN PATENT DOCUMENTS

| | | | |
|---|---|---|---|
| 28,561 | 5/1907 | Austria | 209/498 |

*Primary Examiner*—Tim R. Miles
*Assistant Examiner*—Ralph J. Hill
*Attorney, Agent, or Firm*—M. David Folzenlogen

[57] ABSTRACT

Spherically-shaped rolling solids are separated from irregularly-shaped nonrolling solids on the upper outer surface of a conoidally-shaped rotating table whereon most of the spherically-shaped solids roll from the surface of the table and most of the irregularly-shaped solids move with the table until they are removed off the surface of the table. A mixture of the two types of solids is fed onto the rotating table by a feed system with an inclined spreader chute, which system fluffs the mixture prior to its impacting the table and spreads the solids on the surface area of the table. The action of the spreader plate may be combined with a breaker plate or the rear side of a spiral-like scraper blade. The feed system lessens undesirable impact momentums of the solids. The feed system distributes the solids more uniformly over a greater area of the table, thereby decreasing solids bridging or piling on the table and increasing effective use of the surface area of the table. The feed system allows the solids to flow at angles less than their angle of repose and reduces the vertical space necessary for the feed system. The separating system is especially useful for separating spherically-shaped heat carriers from spent shale solids in an oil shale retorting process.

14 Claims, 3 Drawing Figures

FEED SYSTEM FOR A CONOIDAL SOLIDS SEPARATING SYSTEM AND METHOD OF SEPARATING

CROSS REFERENCE TO RELATED APPLICATIONS

This application is a continuation-in-part of Copending Application Ser. No. 749,589, filed Dec. 10, 1976, entitled "Conoidal Solids Separator with Special Scraper", filed by the same inventor as this invention and owned by a common assignee.

BACKGROUND OF THE INVENTION

This invention relates to a conoidal, rotating table solids separating system with a low momentum, wide area, vertically compact feed arrangement. The separating system is for separating spherically-shaped rolling solids from irregularly shaped nonrolling solids and is especially useful for oil shale retorting facilities using spherically-shaped heat carriers which are recovered and recycled through the retorting process.

There are many systems of separating solids which have significantly different particle sizes or particle weights, but there are relatively few dry, high capacity systems for efficiently separating solids having similar sizes and particle weights.

Copending Application Ser. No. 749,505, filed Dec. 10, 1976, which is entitled "Separation and Recovery of Heat Carriers in an oil Shale Retorting Process", and which is owned by a common assignee and is incorporated herein, described a conically-shaped rotating table separator for separating solids by differences in roll factor. The system is a dry, flexible, high capacity, efficient separating system. In this system, a mixtue of spherically-shaped rolling solids and irregularly shaped nonrolling solids is fed onto the table. The rolling solids roll off the table while the nonrolling solids come to rest on the table and move with the table until they are scraped off the table. These solids collect at the scraper and the operating characteristics of the table are partially affected by the design of the scraper. Copending Application Ser. No. 749,589 provides a special scraper which moves the irregularly-shaped solids in a quasi spiral-like path and increases the separating efficiency of the system.

It is highly desirable that the separating system be compact, yet have a high total capacity. This may be accomplished by increasing the efficiency and capacity per table, and by vertically stacking a number of these efficient rotating tables. Vertical stacking provides a number of other advantages. When solids are fed onto a conoidal table through a standard feed system, the solids tend to bridge and surge inside the feed system. The solids do not flow freely unless the feed system is above the angle of repose of the solids. This angle increases impact momentum, reduces surface area utilization, places undue height limitations on the system especially if the tables are to be vertically stacked, and creates other problems.

The conoidal table separating system uses the difference in rolling properties of the solids. The outer surface of the table is relatively smooth and uniform, and is inclined at an appropriate angle which is less than the static slide angle of the nonrolling solids. This angle is relatively small. The table is rotated to continuously restore the separating surface area, prevent buildup of solids, and for other reasons. When a mixture of solids is fed from a standard feed system onto this type of rotating table, the mixture tends to pile and bridge, and the rolling solids do not flow freely down the table. Moreover, the mixture tends to be tight and the rolling solids tend to spin with the table. The disadvantages of particle interaction are aggrevated. These events cause low separation efficiency and high spherical particle carryover or loss. Moreover, the standard feed system does not efficiently utilize the separating surface area of the system and tends to increase the surface area requirements per unit rate of solids flow.

This invention provides a feed system for a conically-shaped rotating table separator which breaks or fluffs the mixture of solids, spreads the solids over a wide surface area, reduces impact momentum and particle interactions, and allows tables to be vertically stacked with much less height restrictions. This allows each table to be divided into more distinct separating sections and increases the compactness and total capacity of the system per unit area and unit volume of space.

SUMMARY OF THE INVENTION

A system for separating spherically-shaped rolling solids from irregularly-shaped nonrolling solids utilizes the upper surface of a rotating conoidally-shaped table. The surface of the table is appropriately inclined from horizontal by an angle equal to or greater than the static roll angle of the spherically-shaped solids and less than the static slide angle of the irregularly-shaped solids.

A mixture of the solids is fed at a point outside the diameter of the table onto an inclined spreader chute which conducts the solids to the surface of the table or to a breaker plate. The spreader chute widens the flow path of solids into a vertical monolayer, thereby fluffing the solids and permitting the solids to flow at an angle less than their angle of repose. In turn, this allows the impact momentum of the solids to be controlled. The spreader chute also directs the solids in a monolayer over a wide area of the surface of the table, thereby reducing particle bridging or piling, permitting the sphericallyshaped solids to roll more freely off the surface of the table, and increasing utilization of the surface area of the table. The spreader chute may have longitudinally placed vanes which aid in breaking, fluffing and spreading the solids.

In one embodiment, the spreader chute conducts and feeds the mixture onto an inclined breaker plate. The breaker plate further fluffs and widens the distribution of the solids and further controls impact momentum. The solids leave the spreader chute in one direction and the breaker plate causes the solids to move in different or generally reverse direction.

When the solids impinge on the rotating table, most of the spherically-shaped solids roll off the table to suitable receiving means. Most of the irregularly-shaped solids come to rest on the table and move with the table to a point away from the impingement point and are removed by a suitable removal means.

Preferably, the removal means is a specially-shaped scraper and the back side of the scraper may be used in conjunction with the spreader chute. The scraper extends in a downward, outward, circumferential manner. In one embodiment, the scraper is sectionalized and each such section is differently sloped. This triple component direction creates particle movements which free trapped rolling solids and allow them to roll off the table to suitable receiving means with less interference or interaction with irregularly-shaped solids still on the table. This triple component direction allows the irregularly-shaped solids to move circumferentially further away from the feed point than the points where the trapped rolling solids roll off the table, thereby increasing segregation of the solids and separation efficiency. When the scraper is combined with the feed arrangement, the spreader chute is adapted to direct the mixture of solids toward the back side of the scraper. The triple component direction of the scraper makes the back side of the scraper particularly useful for aiding in spreading and directing solids onto the separating surface area of the table.

DETAILED DESCRIPTION

Figure 1:
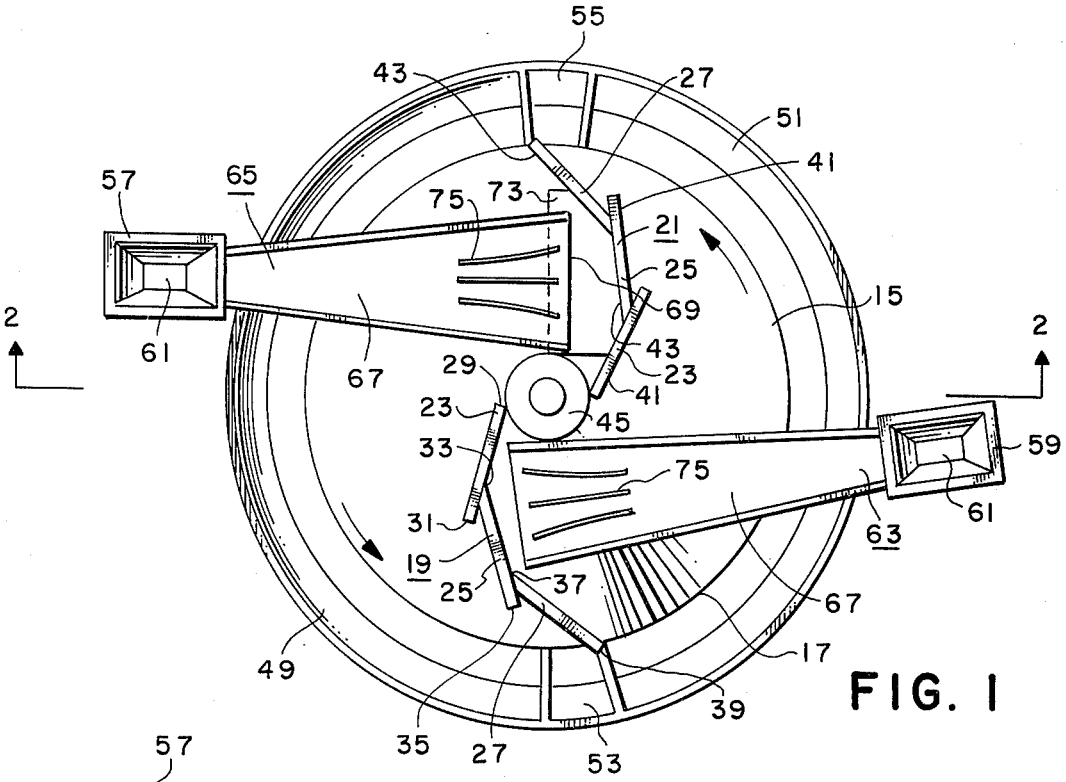
FIG. 1 is a top plan view of a conically-shaped table separator with spreader feed system.
Figure 2:
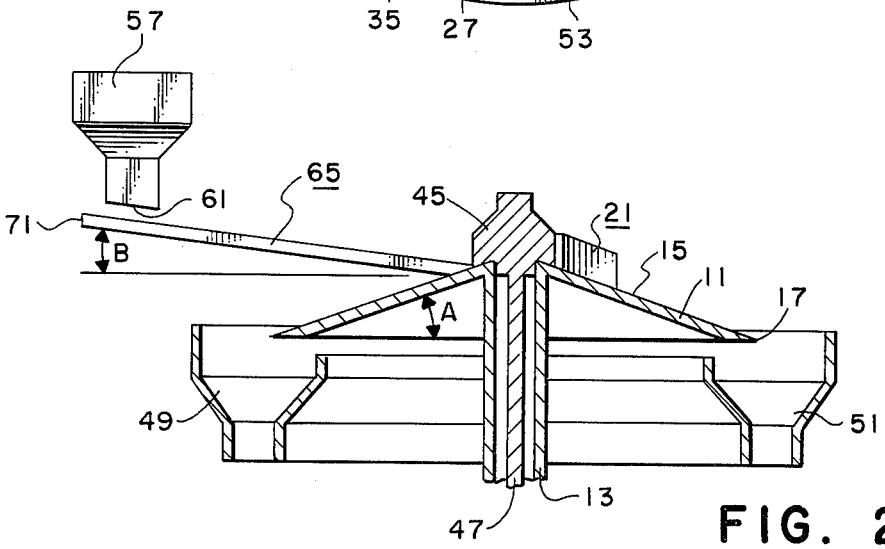
FIG. 2 is a sectionalized, side view of the separator system of FIG. 1.
Figure 3:
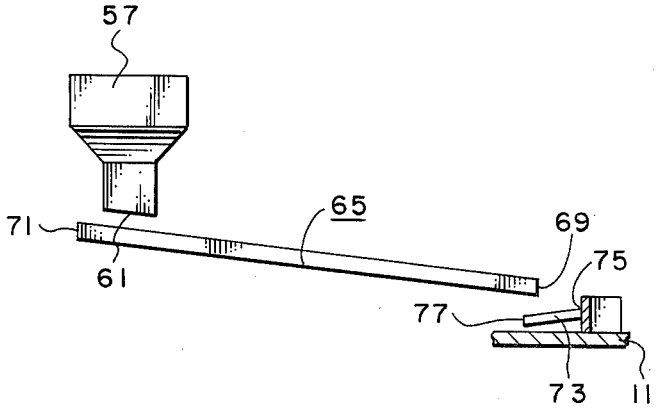
FIG. 3 is a brief fragmented, sectionalized side view of a breaker plate arrangement.

A conically-shaped rotating table separating system with spreader feed arrangement and special scraper is illustrated in FIGS. 1, 2 and 3. As shown, conically-shaped member 11 with its apex pointing up is adapted to rotate about its vertical axis on vertically extending cylindrical shaft 13, which may be rotated by any suitable, controlled speed means. The conically-shaped member has inclined upper, outer surface 15.

Outer surface 15 is the basic medium used in the system for separating spherically-shaped solids which tend to roll down an inclined surface from irregularly-shaped solids which tend to slide down an inclined surface. In other words, the solids may be divided into two groups according to roll factor. The spherically-shaped solids are sufficiently round to roll down inclined outer surface 15 of the conically-shaped member. Generally, it is preferred that the rolling solids have a sphericity factor of ata least 0.9. The sphericity factor is the external or geometric surface area of a sphere having the same volume as the spherically-shaped solid divided by the external surface area of the spherically-shaped solid. The nonrolling solids are sufficiently irregularly-shaped, laminar-like, flat, or rough, that one or more of their sides causes the irregularly-shaped solid not to roll down the inclined outer surface of the conically-shaped table. Instead, the irregularly-shaped solid will tend to come to rest on the outer surface. In processes using or producing a mixture of these two types of the solids, the spherically-shaped solids are usually in a narrower size range than the irregularly-shaped solids and in this size range, the concentration of spherically-shaped solids is greater than the concentration of irregularly-shaped solids.

Outer surface 15 of conically-shaped member 11 is inclined from horizontal at angle A which is at least as great as the static roll angle of the desired size spherically-shaped solids and is less than the static slide angle of the equal size irregularly-shaped solids. The static roll angle of the spherically-shaped solids is determined by holding an approximately median size, rolling solid at rest on the outer surface of the conically-shaped member at a point on the outer surface where a mixture of solids is to be fed onto or initially contact the outer surface and releasing such rolling solid to determine the minimum angle of the outer surface at which the released solid will roll down the outer surface. The static slide angle of the irregularly-shaped solids is determined by holding a nonrolling solid having a size approximately equal to the median size rolling solid at rest on a flat or rough side of the nonrolling solid against the outer surface and releasing the irregularly-shaped solid to determine the minimum angle for the outer surface at which such released solid will slide down the outer surface. The static roll angle of the spherically-shaped solids is less than the static slide angle of the irregularly-shaped solids. These angles inherently take into consideration the smoothness of the outer surface and the interaction between the surface of the solids and the surface of the table. Generally, it is desirable to test a representative number of such solids and a representative number of the different size solids of both types. The tests will be conducted with the table not rotating and will usually be conducted at normal room temperature, that is, 24° C (75° F). When the operating temperature is expected to significantly affect the rolling or sliding characteristics of the solids, it is best to determine these angles at the expected operating temperatures. For example, in an oil shale retorting process, the spherically-shaped solids may bear a combustible organic residue which affect the rolling characteristics of these solids at elevated temperatures.

The outer surface of the conically-shaped member thereby slopes downward with respect to the apex of the conoidal table, and outward or away from the vertical axis of the table until the outer surface of the member ends with lower edge rim 17 which is circular in shape and has a circular periphery. For descriptive purposes, cross-sectional planes of the outer surface of the conically-shaped member perpendicular to the vertical axis of the conically-shaped member may be considered as having circumferential or circular rim edges. Moreover, all of the table above the lower edge rim lies within the periphery of the lower edge rim. In addition, the outer surface may be considered as having a lower surface area portion above and adjacent to the lower edge rim and a higher surface area portion above the lower surface area portion. These periphery considerations, surface area portions, and downward, outward, circumferential directions will be used to describe and explain certain features of the separating system.

As shown, the outer surface of the conically-shaped member is divided into two distinct separating sections by removal means 19 and removal means 21. Each removal means is adapted to coact with rotation of the conically-shaped member and movement of nonrolling solids resting on the outer surface to move the irregularly-shaped solids in a path which extends across the higher and lower surface area portions and terminates near lower edge rim 17. In other words, the removal means extends from above the impingement area where a mixture of solids is fed onto outer surface 15 to the lower edge rim. This path has at least the three component directions previously mentioned so that the irregularly-shaped solids are moved downwardly with respect to the apex of conically-shaped member 11, outwardly with respect to its vertical axis, and circumferentially with respect to the impingement area and with respect to the cross-sectional planes perpendicular to the vertical axis of the conoidal table. This triple component movement coacts with rotation of the table to free trapped rolling solids and enable the two classes of solids to be collected at different points on lower edge rim 17.

As shown, removal means 19 and 21 are sectionalized scraper blades. Each blade has first section 23, second section 25, and third section 27. First section 23 has upper end 29 and lower end 31. Second section 25 has upper end 33 and lower end 35. Third section 27 has upper end 37 and lower end 39. Upper end 29 of the first section is at an elevation higher than upper end 33 of the second section which is, in turn, at an elevation higher than upper end 37 of the third section. The lower edge of each section of each scraper blade is close enough to outer surface 15 to scrape or deflect significant sized irregularly-shaped solids off the table. It is preferred that substantially all of the solids be removed except, perhaps, for very fine dust which passes under the scraper. Each section has front side 41 which extends upward from the lower edge of each section and is adapted to deflect or move solids off the table. This front side extends in a downward, outward, and circumferential direction with respect to the direction of rotation of its respective impingement area of the outer surface away from the point where a mixture of solids is fed onto the table. Each section has trailing side 43 which extends upward from the lower edge of each section and is generally parallel to front side 41. The trailing side, therefore, also extends in a downward, outward, and circumferential direction. The front side of each scraper blade faces the impingement area of its respective separating section of the table so that solids moving on the table come into contact with the front side. On the other hand, solids on the rotating table in the same separating section move away from the trailing side of the other scraper blade.

The action of the scraper blade is enhanced by changing the degree of circumferential extension or movement per unit of outward movement or extension of each section of the scraper. As shown, for each unit of outward extension, the ratio of the circumferential extension to the downward extension of each section is greater for third section 27 than it is for second section 25, and the ratio for the second section is greater than it is for first section 23.

Removal means 19 and 21 are stationary and are mounted at their upper ends to hub 45 which in turn is mounted on stationary rod 47, shown in FIG. 2. This rod passes through the hollow cylindrical passage in vertically extending cylindrical shaft 13. This permits rotation of conically-shaped member 11 without movement of removal means 19 and 21.

In line with and below a portion of circular lower edge rim 17 are first receiving means 49 and 51 which are adapted to receive spherically-shaped solids rolling from outer surface 15 off the lower edge rim by the removal means. First receiving means 49 and 51 are any sort of system, e.g., one or more troughs, catchers, or chutes, for receiving the spherically-shaped solids. These receiving means are located and positioned below and circumferentially around the portions of conically-shaped member 11 where the spherically-shaped solids roll from the surface.

In line with and below other portions of circular lower edge rim 17 are second receiving means 53 and 55 which are adapted to receive irregularly-shaped solids moved from outer surface 15 off the lower edge rim by the removal means. The second receiving means are any sort of system, e.g., one or more troughs, catchers, or chutes, for receiving the irregularly-shaped solids. This second receiving system is located and positioned below and circumferentially around the portions of conically-shaped member 11 where the irregularly-shaped solids leave the outer surface adjacent the lower ends of each removal means.

Outside the periphery of lower edge rim 17 and preferably outside the periphery of receiving means 49 and 51 are supply means 57 and 59 which are any sort of systems, e.g., chutes, pipes, or passages, adapted to feed a mixture of spherically-shaped and irregularly-shaped solids through opening 61 onto an upper portion of inclined spreader chutes 63 and 65. In a supply means of this nature, the solids do not flow freely unless the passage is above the angle of repose of the solids, that is, the angle from horizontal above which the solids do not bridge in the passage. This angle is large enough to cause vertical space and other type problems. For example, for the type of heat carriers and spent oil shale solids hereinafter mentioned, the angle of repose was found to be about 28° to 45°. As shown, the angle of passage in the supply means is between 45° and 90°. The supply means must be outside the periphery of the table so that the tables may be compactly stacked and so that the inclined spreader chute may be appropriately inclined.

As shown in FIG. 1, inclined spreader chutes 63 and 65 have similar features so they will be given similar reference numerals. The spreader chute has bottom surface 67, lower end 69, shown in FIGS. 1 and 3, and upper end 71 which is shown in FIG. 2. Upper end 71 is outside the periphery of lower edge rim 17 and the periphery of the receiving means. Lower end 69 is inside these peripheries and is above outer surface 15 of the conically-shaped member by a preselected distance. The preselected distance must be at least as great as the size of most of the solids to be separated on the table. Otherwise, the solids could not move with the table. The distance will also be dependent on how the solids are finally fed onto the table and impact momentums. Each spreader chute is adapted to receive a mixture of solids flowing from a supply means through opening 61 onto the chute and to pass this mixture off the lower end of the chute into another surface. The surface may be the solids impingement area of the outer surface of the conically-shaped table or it may be breaker plate 73 shown in FIGS. 1 and 3. This breaker plate will hereinafter be discussed.

The bottom surface of the spreader chute widens at its lower end which is wider than its upper end and the width of opening 61 through which the mixture is fed onto the spreader chute and is wide enough to allow the mixture to spread into a vertical monolayer on the bottom surface. The word "monolayer" refers to a single layer of solids with respect to vertical or an axis perpendicular to the bottom surface. In other words, the width of the bottom is wide enough to let the solids spread out so that the solids are not stacked on top of the other. This width is necessary to assure that the solids may flow freely at an angle which is less than the angle of respose of the solids. This reduces the height limitations of the feed system and allows the tables to be compactly stacked. This width is also necessary ro proper fluffing of the solids and to proper distribution of the solids into a monolayer onto the impingement area of the table.

The bottom surface of the spreader chutes are inclined from horizontal along their longitudinal axis by angle B which is shown in FIG. 2. For vertical stacking purposes and other reasons, this angle is substantially less than the angle of repose of the solids. This plus the width of the spreader chute causes the solids to spread into a monolayer and enables the impact momentum of the solids when they leave lower end 69 to be better controlled or reduced.

The bottom surface is substantially parallel to horizontal along its width or lateral axis. This is necessary to proper spreading and distribution of the solids. If the bottom were inclined right or left, the solids would tend to gravitate or pile up along one side of the spreader chute.

Preferably, to further assure fluffing of the solids and better, more even distribution of the solids off lower end 69, the inclined spreader plate will have two or more thin, fixed spreader vanes 75, shown in FIG. 1. These vanes or vertical walls extend upward from the bottom surface of the inclined spreader chute and generally longitudinally with the spreader chute except that they are curved or slanted to direct and spread the solids off lower end 69. In other words, the vanes are adapted to direct solids moving down the bottom surface of the chute in a spreading pattern onto another surface. The other surface may be the impingement area of outer surface 15 or it may be breaker plate 73. Inclined spreader chute 63 is adapted or positioned to direct the mixture of solids leaving its lower end toward trailing edge 43 of the scraper blade. The spiral-like nature of the scraper blade enables it to act as a breaker wall to deflect the solids back along the table and to not let the solids move directly downward off the table.

Inclined spreader chute 65 is adapted or positioned to direct the mixture of solids leaving its lower end onto inclined breaker plate 73. Inclined breaker plate 73 has upper edge 75 and lower edge 77, shown in FIG. 3. The breaker plate is adapted or positioned to receive a mixture of solids from inclined spreader chute 65 and to pass the mixture to an impingement area of outer surface 15 of the conoidal table. The breaker plate is inclined from horizontal in a manner such that its lower edge is closer to supply means feeding spreader chute 65 than its upper end and in a manner such that lower edge 77 is at an elevation lower than lower end 69 of the inclined spreader chute. In this manner, the solids move off lower end 69 of the spreader chute going to the trailing side of a scraper blade and then breaker plate moves the solids in a different or sort of reverse direction. This further fluffs the solids and spreads them. In addition, the breaker plate may be closer to the outer surface of the table since particles do not need to pass under it. This provides additional control over the impact momentum of the solids onto the separating surface and directs them in a preferred direction so that the rolling solids may roll free of the irregularly-shaped nonrolling solids.

In operation, conically-shaped member 11 is rotated at an appropriate speed and a mixture of spherically-shaped solids and irregularly-shaped solids is fed at feed points onto the upper portion of an inclined spreader chute. This upper portion is outside the periphery of the conically-shaped member. The mixture on the inclined spreader chute is passed from the upper portion of the spreader chute off its lower end onto another surface. The other surface may be the outer surface of the table or the upper surface of a breaker plate.

As the solids move down the spreader chute, they spread out into a monolayer and their momentum is reduced. The movement of the solids is further spread and distributed by vanes 75.

If the solids are passed directly onto outer surface 15, it is preferred that they be directed toward the trailing or rear edge of a scraper blade. In such case, some of the solids will fall onto the rotating outer surface and move with the table. Some of the solids may initially move against the trailing side scraper and then move with, or down the table, or both with and down the table.

If the solids are passed onto breaker plate 73, the solids leave the inclined spreader chute going in a first direction and then the solids move or are passed on the breaker plate in a second different direction generally back toward the spreader chute and onto the impingement area of the outer surface of the conoidal table. This further increases fluffing and disribution of solids.

In any event, the solids are fluffed, spread, and distributed in a wide area on the rotating table. On the table, most of the spherically-shaped solids are allowed to roll from the outer surface where they fall off lower edge rim 17 into and are collected by receiving means 49 and 51. Most of the irregularly-shaped solids come to rest and remain on the outer surface. Some of the spherically-shaped solids may be caught and held by the irregularly-shaped solids.

At the same time, as shown, conically-shaped member 11 is rotated in a constant counterclockwise direction and the spherically-shaped and irregularly-shaped solids remaining on the outer surface 15 move in generally circular or circumferential path away from the feed point around the vertical axis of the conically-shaped member and a clean, continuously restored impingement area is moved under the supply means. As the conically-shaped member is rotated, some the the trapped spherically-shaped solids may roll free from the irregularly-shaped solids and roll off the inclined conoidal surface into the receiving means.

Continued rotation of the conically-shaped member causes the irregularly-shaped solids to move away from the feed point to a second point located away from the feed point where the solids on the table contact a removal means and are removed off the outer surface of the table to receiving means 53 and 55.

At the second point, it is preferred that the deflecting nature of the removal means and the moving force of the table and the sliding, nonrolling characteristics of the irregularly-shaped solids move the irregularly-shaped solids in a downward direction away from hub 45, in an outward direction with respect to the vertical axis of the conically-shaped member, and in a circumferential direction with respect to the feed point and the circular or rotating path that the outer surface takes as the conically-shaped member is rotated, This removes the irregularly-shaped solids from the outer surface adjacent the lower end of the removal means. This frees rolling solids and enhances segregation of the solids leaving the table.

The volumes and relative amounts and sizes of the solids in the mixture will affect the overall design of the separating system. The spherically-shaped solids or normally in a relatively narrow size range when compared to the irregularly-shaped solids. The conoidally-shaped rotating table system is especially suited to mixtures of solids wherein the spherically-shaped solids and the irregularly-shaped solids are in a similar size range and the weight concentration of the irregularly-shaped solids is less than twenty percent. The system is especially suited to solids having a size above 0.14 centimeter (0.055 inch). It is best to first remove most or all of the larger size and smaller size irregularly-shaped solids, especially fine size solids. Fortunately, it is usually relatively easy to separate and remove these undesired size solids.

If there is an appreciable amount of irregularly-shaped solids which are larger than the spherically-shaped solids and the volumes to be handled justify it, it would be best to first process the mixture to separate at least a portion of the larger irregularly-shaped solids prior to using the conoidal rotating table system. The larger size irregularly-shaped solids may be separated by screening. This initial screening or separation of the larger size solids is optional and this step may be delayed until after some of the smaller size irregularly-shaped solids are removed.

By the same token, if the amount of irregularly-shaped solids smaller than the spherically-shaped solids is sufficiently large to warrant it, it would be best to remove at least a portion of the finer irregularly-shaped solids prior to treating the mixture on the inclined outer surface of the table. Fine size solids greatly affect rolling characteristics and tend to unduly adhere to the separating surface of the table. A significant portion, especially fines, of the smaller size irregularly-shaped solids may be removed by screening or by a low velocity elutriating gas. If the system is to be operated at elevated temperatures, it will be desirable to heat the gas used in elutriation. The gas should be a noncombustion supporting gas if there are combustible materials present on the solids.

The separating system of this invention is particularly advantageous for separating spherically-shaped heat carriers from irregularly-shaped spent shale, especially porous pellet heat carriers in a size range of between 0.14 centimeter (0.055 inch) to approximately 1.27 centimeter (0.5 inch) of the type described in U.S. Pat. No. 3,844,929. In oil shale retorting, mined crushed oil shale is mixed with hot, heat-carrying spherically-shaped solids in a retort. The heat in the hot heat carriers pyrolyzes oil and gas vapors from the oil shale and produces a mixture of spherically-shaped solids and nonrolling spent shale. After retorting, the solids mixture is processed to recover the heat carriers for recycle through the retorting process and for separation and disposal of the spent shale. This separation and recovery of solids is usually accomplished in several stages. One of the separating stages will use the conoidally-shaped rotating table system of this invention. As mentioned in Copending Application Ser. No. 749,505, the efficiency of this process will be increased if a portion of the irregularly-shaped spent shale solids larger then the heat carriers is removed and if a portion of the irregularly-shaped spent shale solids smaller than the heat carriers is removed prior to processing a mixture of the remaining solids on the inclined outer surface of the rotating table system of this invention.

The foregoing description and explanation provide a dry, high capacity, flexible, efficient system for separating rolling solids from nonroling solids which uses a conically-shaped table with a spreading low momentum feed arrangement that increases the surface utilization of the table and separation efficiency and enables the system to be made more compact while retaining a high capacity at the desired separation efficiency level. It is understood that variations and modifications may be made thereon, and it is intended to cover in the appended claims all such variations and modifications as fall within the spirit and scope of the invention.

The embodiments of the invention in which an exclusive property or privilege is claimed are defined as follows:

1. A system for separating spherically-shaped solids which tend to roll down an inclined surface from irregularly-shaped solids which tend to slide down an inclined surface comprising:

a. a conically-shaped member with its apex pointing up, said conically shaped member being adapted to rotate about its vertical axis and having an outer surface inclined from horizontal at an angle at least as great as the static roll angle of the spherically-shaped solids and less than the static slide angle of the irregularly-shaped solids, said outer surface having a circular-shaped lower edge rim;

b. supply means adapted to feed a mixture of said spherically-shaped solids and said irregularly-shaped solids through an opening onto an upper part of an inclined spreader chute;

c. said inclined spreader chute having a bottom surface, a lower end and an upper end and being adapted to receive said mixture from said supply means and tc pass said mixture from said supply means off said lower end onto an impingement area of said outer surface of said conically-shaped member, said inclined spreader chute having its upper end outside the periphery of said lower edge rim and its lower end inside said periphery, said bottom surface being inclined from horizontal along its longitudinal axis and being substantially parallel to horizontal along its lateral axes, said bottom surface being wider at said lower end than it is at said upper end and being substantially wider at said lower end than the width of said opening through which said mixture is fed by said supply means onto said inclined spreader chute, said bottom surface being wide enough to allow said mixture to spread into a vertical monolayer on said bottom surface, said lower end of said bottom surface being above said outer surface of said conically-shaped member by a preselected distance, said distance being at least as great as the size of most of the solids to be separated by said system;

d. means adapted to receive spherically-shaped solids rolling from said outer surface off said lower edge rim;

e. removal means adapted to remove irregularly-shaped solids from said outer surface off said lower edge rim, and f. means adapted to receive irregularly-shaped solids removed from said outer surface off said lower edge rim by said removal means.

2. The system of claim 1 wherein the inclined spreader chute has at least two thin fixed spreader vanes extending upward from the bottom surface of said inclined spreader chute and adapted to direct moving solids in a spreading pattern onto the impingement area of the outer surface of the conically-shaped member.

3. The system of claim 1 wherein the removal means is a scraper blade having an upper end at an elevation higher than the impingement area of the outer surface and a lower end near the lower edge rim of the conically-shaped member, said scraper blade having a lower edge just above and generally parallel to said outer surface of said conically-shaped member and a front side extending upward from said lower edge, said front side being adapted to deflect irregularly-shaped solids moving with said outer surface, said front side extending from said upper end to said lower end in a downward direction with respect to the apex of said conically-shaped member, an outward direction with respect to the vertical axis of said conically-shaped member, and a circumferential direction with respect to the supply means and to the perimeter of cross sectional planes perpendicular to the vertical axis of said conically-shaped member, said scraper blade having a trailing side extending upward from said lower edge and generally parallel to said front side, and the inclined spreader chute is adapted to direct the mixture of solids toward said trailing side of said scraper blade.

4. The system of claim 3 wherein the scraper blade is comprised of at least two sections, each of said sections having a different ratio of the amount of circumferential extension to the amount of downward extension per unit of outward extension of said section.

5. The system of claim 3 wherein said inclined spreader chute has at least two thin fixed spreader vanes extending upward from the bottom surface of said inclined spreader chute and adapted to direct moving solids in a spreading pattern onto said impingement area of said outer surface of said conically-shaped member.

6. A system for separating spherically-shaped solids which tend to roll down an inclined surface from irregularly-shaped solids which tend to slide down an inclined surface comprising:

a. conically-shaped member with its apex pointing up, said conically-shaped member being adapted to rotate about its vertical axis and having an outer surface inclined from horizontal at an angle at least as great as the static roll angle of the spherically-shaped solids and less than the static slide angle of the irregularly-shaped solids, said outer surface having a circular-shaped lower edge rim;

b. supply means adapted to feed a mixture of said spherically-shaped solids and said irregularly-shaped solids through an opening onto an upper part of an inclined spreader chute;

c. said inclined spreader chute having a bottom surface, a lower end and an upper end and being adapted to receive said mixture from said supply means and to pass said mixture from said supply means off said lower end onto an upper part of an inclined breaker plate, said inclined spreader chute having its upper end outside the periphery of said lower edge rim and its lower end inside said periphery, said bottom surface being inclined from horizontal along its longitudinal axis in a manner such that said lower end is further away from said supply means than said upper end and being substantially parallel to horizontal along its lateral axes, said bottom surface being wider at said lower end than it is at said upper end and being substantially wider at said lower end than the width of said opening through which said mixture is fed by said supply means onto said inclined spreader chute, said bottom surface being wide enough to allow said mixture to spread into a vertical monolayer on said bottom surface, said lower end of said bottom surface being above said outer surface of said conically-shaped member by a preselected distance, said distance being at least as great as the size of most of the solids to be separated by said system;

d. said inclined breaker plate having an upper breaker edge and a lower breaker edge and being adapted to receive said mixture from said inclined spreader chute and to pass said mixture to an impingement area of said outer surface of said conically-shaped member, said inclined breaker plate being inclined from horizontal in a manner such that said lower breaker edge is closer to said supply means than said upper breaker edge and closer to said supply means than said lower end of said inclined spreader chute, said lower breaker edge being at an elevation lower than said lower end of said inclined spreader chute;

e. means adapted to receive spherically-shaped solids rolling from said outer surface off said lower edge rim;

f. removal means adapted to remove irregularly-shaped solids from said outer surface off said lower edge rim, and g. means adapted to receive irregularly-shaped solids moved from said outer surface off said lower edge rim by said removal means.

7. The system of claim 6 wherein the inclined spreader chute has at least two thin fixed spreader vanes extending upward from the bottom surface of said inclined spreader chute and adapted to direct moving solids in a spreading pattern onto the inclined breaker plate.

8. The system of claim 6 wherein the removal means is a scraper blade having an upper end at an elevation higher than the impingement area of the outer surface and a lower end near the lower edge rim of the conically-shaped member, said scraper blade having a lower edge just above and generally parallel to said outer surface of said conically-shaped member and a front side extending upward from said lower edge, said front side being adapted to deflect irregularly-shaped solids moving with said outer surface, said front side extending from said upper end to said lower end in a downward direction with respect to the apex of said conically-shaped member, an outward direction with respect to the vertical axis of said conically-shaped member, and a circumferential direction with respect to the supply means and to the perimeter of cross sectional planes perpendicular to the vertical axis of said conically-shaped member, said scraper blade having a trailing side extending upward from said lower edge and generally parallel to said front side, and the inclined spreader chute is adapted to direct the mixture of solids toward said trailing side of said scraper blade and onto the inclined breaker plate.

9. The system of claim 8 wherein the scraper blade is comprised of at least two sections, each of said sections having a different ratio of the amount of circumferential extension to the amount of downward extension per unit of outward extension of said section.

10. The system of claim 8 wherein said inclined spreader chute has at least two thin fixed spreader vanes extending upward from the bottom surface of said inclined spreader chute and adapted to direct moving solids in a spreading pattern onto said inclined breaker plate.

11. A method for separating spherically-shaped solids which tend to roll down an inclined surface from irregularly shaped solids which tend to slide down an inclined surface comprising:

a rotating a conically-shaped member having its apex pointing up and having an outer surface inclined from horizontal at an angle which is at least as great as the static roll angle of said spherically-shaped solids and which is less than the static slide angle of said irregularly-shaped solids, said outer surface having a circular-shaped lower edge rim;

b. feeding a mixture of spherically-shaped solids and irregularly-shaped solids at a feed point onto an upper portion of an inclined spreader chute, said upper portion being outside the periphery of said lower edge rim;

c. passing said mixture from said upper portion of said inclined spreader chute off a lower end of said inclined spreader chute onto an impingement area of said outer surface of said rotating conically-shpaed member;

d. allowing most of said spherically-shaped solids fed onto said outer surface to roll down off said outer surface;

e. collecting the spherically-shaped solids which have rolled off said outer surface;

f. moving a portion of said outer surface with irregularly-shaped solids thereon to a second point located away from said feed point; and g. at said second point, moving irregularly-shaped solids off said outer surface.

12. The method according to claim 11 wherein in step (g), the irregularly-shaped solids are moved in a downward direction, an outward direction with respect to the vertical axis of said conically-shaped member, and a circumferential direction with respect to the feed point and the rotating path of the outer surface.

13. The method of claim 11 wherein in step (c), the mixture is passed in a first direction off the lower end of the inclined spreader chute onto the upper portion of an inclined breaker plate, and the mixture on said inclined breaker plate is passed in a second direction from said inclined breaker plate off a lower end of said inclined breaker chute onto an impingement area of the outer surface of the rotating conically-shaped member, said first direction being different from said second direction.

14. The method according to claim 13 wherein in step (g), the irregularly-shaped solids are moved in a downward direction, an outward direction with respect to the vertical axis of said conically-shaped member, and a circumferential direction with respect to said feed point and the rotating path of said outer surface.

* * * * *